US007611216B2

(12) United States Patent
Sussmeier

(10) Patent No.: US 7,611,216 B2
(45) Date of Patent: Nov. 3, 2009

(54) METHOD AND SYSTEM FOR CORRECTING PRINT IMAGE DISTORTION DUE TO IRREGULAR PRINT IMAGE SPACE TOPOGRAPHY

(75) Inventor: John W. Sussmeier, Cold Springs, NY (US)

(73) Assignee: Pitney Bowes Inc., Stamford, CT (US)

( * ) Notice: Subject to any disclaimer, the term of this patent is extended or adjusted under 35 U.S.C. 154(b) by 469 days.

(21) Appl. No.: 11/188,022

(22) Filed: Jul. 22, 2005

(65) Prior Publication Data

US 2007/0019017 A1 Jan. 25, 2007

(51) Int. Cl.
*B41J 29/38* (2006.01)

(52) U.S. Cl. ..... 347/14; 347/8

(58) Field of Classification Search ..... 347/14, 347/8, 19, 101, 104–107
See application file for complete search history.

(56) References Cited

U.S. PATENT DOCUMENTS 5,043,740 A * 8/1991 Kneezel et al. ..... 347/12
5,793,392 A * 8/1998 Tschida ..... 347/40
6,345,879 B1 * 2/2002 Fisher ..... 347/40
6,360,656 B2 * 3/2002 Kubo et al. ..... 101/35
6,754,551 B1 * 6/2004 Zohar et al. ..... 700/121
6,783,290 B2 8/2004 Sussmeier
6,796,628 B2 9/2004 Miller
2005/0280665 A1 * 12/2005 Flotats et al. ..... 347/8

FOREIGN PATENT DOCUMENTS

EP 0925928 A2 6/1999

* cited by examiner

*Primary Examiner*—Thinh H Nguyen
(74) *Attorney, Agent, or Firm*—Christopher H. Kirkman; Angelo N. Chaclas

(57) ABSTRACT

A method and system are disclosed for ejecting ink drops from a plurality of ink jet nozzles in order to print on an envelope in a mail piece production process. The envelope has been stuffed and is therefore not flat, especially near the edges. Mail piece composition data is obtained and stored for the mail piece, and based upon that composition data a nozzle delay pattern is determined. For each ink jet nozzle, ink is ejected in accordance with the delay pattern so as to contact a point of the envelope's surface at the same time as drops from other ink jet nozzles.

10 Claims, 4 Drawing Sheets

METHOD AND SYSTEM FOR CORRECTING PRINT IMAGE DISTORTION DUE TO IRREGULAR PRINT IMAGE SPACE TOPOGRAPHY

TECHNICAL FIELD

The present invention relates to printing on envelopes in a mail production process.

BACKGROUND OF THE INVENTION

Mail production systems such as those applicable for use with the present invention, are typically used by organizations such as banks, insurance companies and utility companies for producing a large volume of specific mailings where the contents of each mail item are directed to a particular addressee. Also, other organizations, such as direct mailers, use inserts for producing a large volume of generic mailings where the contents of each mail item for each addressee are substantially identical.

A typical inserter system for producing mail will, in some respects, resemble a manufacturing assembly line. Sheets and other raw materials (e.g. enclosures, and envelopes) enter the inserter system as inputs. Then, a plurality of different modules or workstations in the inserter system work cooperatively to process the sheets until a finished mail piece is produced. The exact configuration of each inserter system depends upon the needs of each particular installation or customer.

Normally, inserter systems prepare mail pieces by gathering collations of documents on a conveyor. The collations are then transported on the conveyor to an insertion station where they are automatically stuffed into envelopes. After being stuffed with the collations, the envelopes are removed from the insertion station for further processing. Such further processing may include automated closing and sealing the envelope flap, weighing the envelope, applying postage to the envelope, and finally sorting and stacking the mail pieces.

Mail processing machines are often required to process up to 22,000 pieces of mail an hour. Such a high processing speed may require envelopes in an output subsystem to have a velocity in a range of 100-120 inches per second (ips) for processing. Postage meters are time sensitive components of a mail processing system, and they must print a clear postal indicia on the appropriate part of the envelope to meet postal regulations.

Older techniques for printing on envelopes in a mail production process involve mechanical print technology, such as a mechanical print head that comes into contact with the envelope. However, digital printing, such as thermal inkjet technology, is increasingly used, as described in Sussmeier (U.S. Pat. No. 6,783,290), according to which a mail piece is decelerated for printing, and then accelerated when the printing is done; this Sussmeier patent is fully incorporated herein by reference.

Facing identification mark (FIMs), indicias, and text are often printed with distortion, because of varying displacements between the print nozzle plane and points within the print image space. These distorted images can negatively affect machine and human read rates.

FIMs and indicias printed on envelopes to USPS specification are typically located very close to the edge of an envelope. For mail of significant thickness, the edges of the envelope are curved rather than flat, and so the ink droplet must travel farther before reaching the paper for points nearer to the edge. As envelope velocities get higher, the ink drop will be more displaced from its intended target position, thus causing greater image distortion. With increased paper velocity, image distortion increases, resulting in higher likelihood of encountering machine readability problems.

Stepped mail introduces a similar problem. Stepped mail involves thick inserts like compact discs (CDs), credit cards, or other discs (e.g. DVDs). These inserts can be located fully or partially under the printed image space, either due to shifting within the envelope, or due to fixed positioning within the envelope. Again, this produces irregularities on the envelope surface, and consequent image distortion due to variations in ink drop time.

Of course, it would theoretically be possible to print on the envelopes before material is inserted into the envelopes. However, this type of approach can be disadvantageous for various reasons. For example, there could be integration problems with existing mail processing equipment which already print after stuffing. Another example is if a stuffing error causes an envelope to be discarded, it would be simpler to discard an envelope that has not yet been printed, and so there would be no need for reprinting FIMs, indicia, or text.

In U.S. Pat. No. 6,796,628, titled Contour Correcting Printer, and assigned to the assignee of the present invention, a printer is described that is suitable for printing on contoured surfaces. That patent is hereby incorporated by reference in its entirety. In a mail production environment, however, there is a need to print on variably contoured mail piece surfaces quickly, and without complicated measurements being done on the mail piece. Accordingly, the printer described in the prior patent may not be suitable by itself for use with mail production systems discussed above.

SUMMARY OF THE INVENTION

The present invention can improve machine read rates to satisfy United States Postal Service (USPS) requirements, by providing a solution for correcting print image distortion through application of appropriate delays to nozzle firing events. By preventing image distortion on a surface having irregular topography, this invention improves both machine barcode readability as well as human readability of the printed image. Also, because the invention helps to offset the negative effects of velocity increases, the printing process can be accomplished while the mail piece is moving at a higher velocity, and thus more mail pieces can potentially be processed during a given period of time.

This invention adjusts the timing of ink drops being released from an ink jet printer in order to compensate for non-flat surfaces, so that ink drops from different nozzles will arrive on a non-flat surface at the same time. In on of the preferred embodiments, this invention operates on mass-produced mail pieces where the characteristics of the mail piece are known in advance through empirical observation. For example, it can be observed that a certain type of envelope, containing a certain number of pages and inserts, will have a certain curved shape. Based on this knowledge of the components of a given mail piece, it is known which delay characteristics to invoke in the printing process.

This correction means can be applied not just to thermal ink jets for mailing applications, but rather can be used for any application where there is relative motion between the print array and the print image space, using any drop-on-demand or continuous-drop technologies. For example, the correction means can be used for printing applications, like barcodes or text, where printing is required onto any product having irregular or curved topology on a moving assembly line.

BEST MODE FOR CARRYING OUT THE INVENTION

Figure 1:
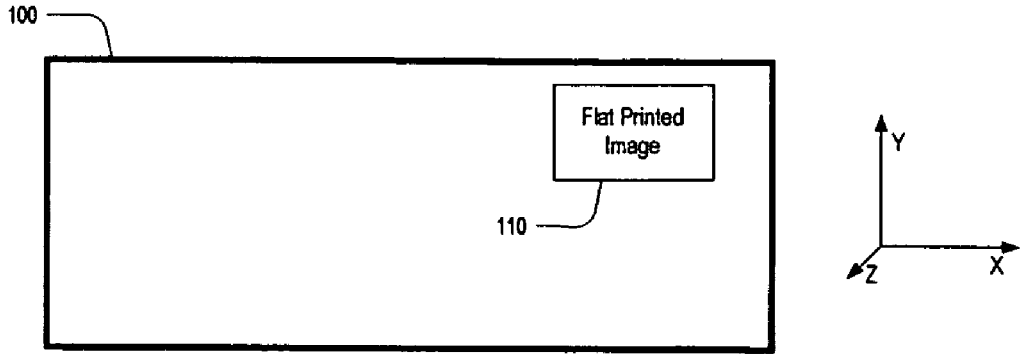
FIG. 1 is a top view of a flat envelope.
Figure 2:
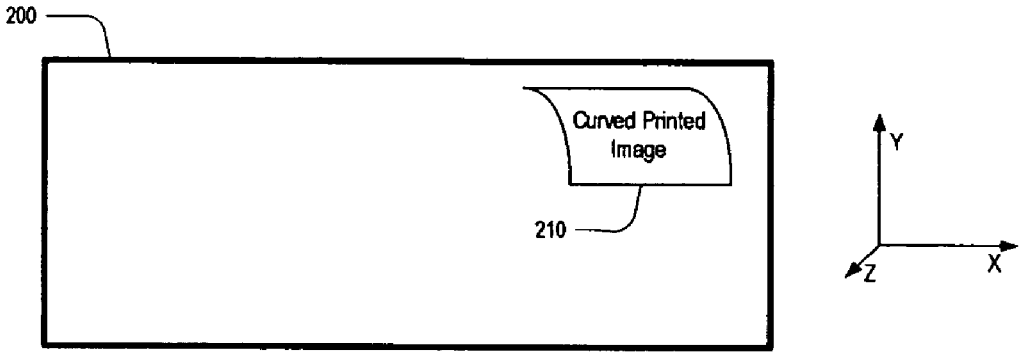
FIG. 2 is a top view of a stuffed envelope.

FIG. 1 shows a flat envelope 100 having a flat printed image 110. This envelope is moving in the x-direction, and will not have any of the difficulties associated with printing on a curved surface. FIG. 2, however, shows a stuffed envelope 200 that consequently will have a curved print image 210. This is the kind of mail piece that the present invention addresses.

Figure 3:
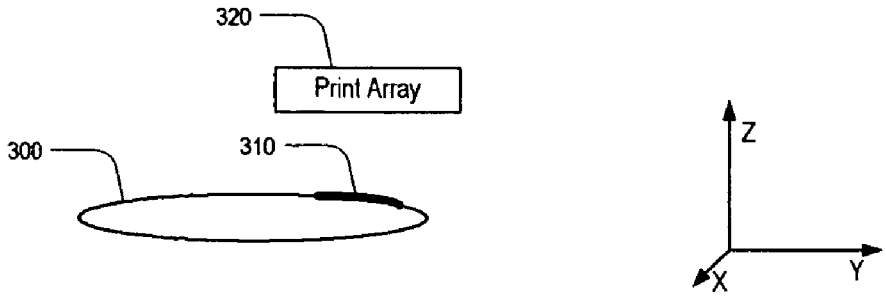
FIG. 3 is a side view of a stuffed envelope, printed image, and print array for printing the printed image.

FIG. 3 shows a mail piece 300 that is moving in the x-direction (i.e. out of the page). The curved printed image 310 will be printed by the print array 320.

Figure 4:
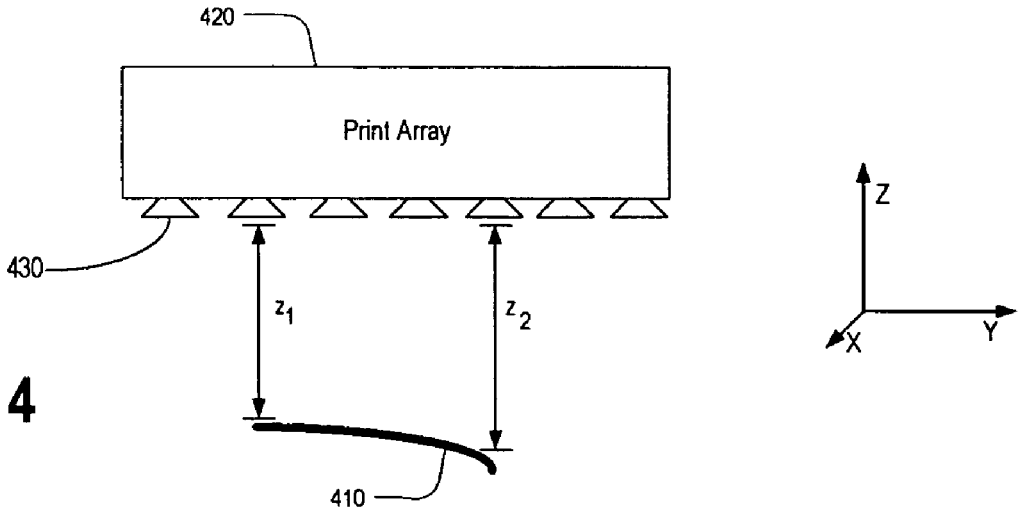
FIG. 4 is an enlarged view of the printed image and print array shown in FIG. 3.

FIG. 4 shows an enlarged print array 420 for printing the curved printed image 410. According to this embodiment of the present invention, a single line of ink jet nozzles 430 that exist in the print array 420 are positioned perpendicular to the x-direction of paper travel. To correct for print image distortion, a time delay is added to the normal fire event for each nozzle fire, as a function of the relative distance of a point under the nozzle to a point on the image space that is farthest from the nozzle array plane. For a single line of nozzles, the required time delay for each nozzle possessing a unique value for relative displacement, dZ, is:

$$\text{Delay Time}=dZ/V_{drop}$$

Here, "$V_{drop}$" is the velocity of the ink drop. "dZ" is the relative displacement from the image point to a point on the image space that is farthest to the nozzle plane, so in the example shown in FIG. 4 we have $dZ=Z_2-Z_1$.

For the invention to succeed, two- or three-dimensional topographical mapping information must be acquired. This information can be measured, estimated, or is known beforehand. Methods to measure the topography include optical, physical contact, and acoustic techniques. Estimation methods include knowledge of the amount of material, or the total weight of the material within a mail piece. If the invention is used in non-mailing applications, knowledge of the shape of the item about to be printed may already be known (e.g. a beverage container on an assembly line).

By using a two-dimensional estimation, the invention can be simplified, thereby potentially increasing its practicality. The dimension in the direction of the paper path, X, can be neglected. For example, on an insertion machine, envelopes that have a known amount of material or weight stuffed into them are common. Therefore, the two-dimensional print image space topography can be approximated, instead of being measured. This approximation can be used as an input into the algorithm that applies the correction by applying an appropriate delay to the normal fire event for each ink drop fired.

Print arrays may be fired using either "time-based" or "displacement-based" methods. For time-based, pulses are fired at a constant frequency, regardless of the envelope displacement. If the transport is servo-driven, its velocity will dither around the nominal transport velocity, and the printed image can contain aberrations due to this dithering. For displacement-based , the fire pulses are derived from an encoder that is directly mounted to either the transport or an idler on the envelope. This has the advantage of decreasing the sensitivity to velocity fluctuations, thereby reducing print aberrations. For either case, the normal fir events are either based on time or displacement.

Typical transport velocities for mailing machines are now 100 inches per second or greater. Typical ink drop velocities for a thermal ink jet nozzle range from 6 to 25 meters per second. By way of example, consider a printing system with a drop velocity of 20 meters per second. For a point on the image space that is 3 mm closer to the nozzle plane than the farthest point on the image space (which is likely to be located near the edge of an envelope), the Delay Times would be equal to 0.003 divide by 20, or 150 microseconds. The Delay Time for the point farthest away from the nozzle plane would be zero.

Figure 5:
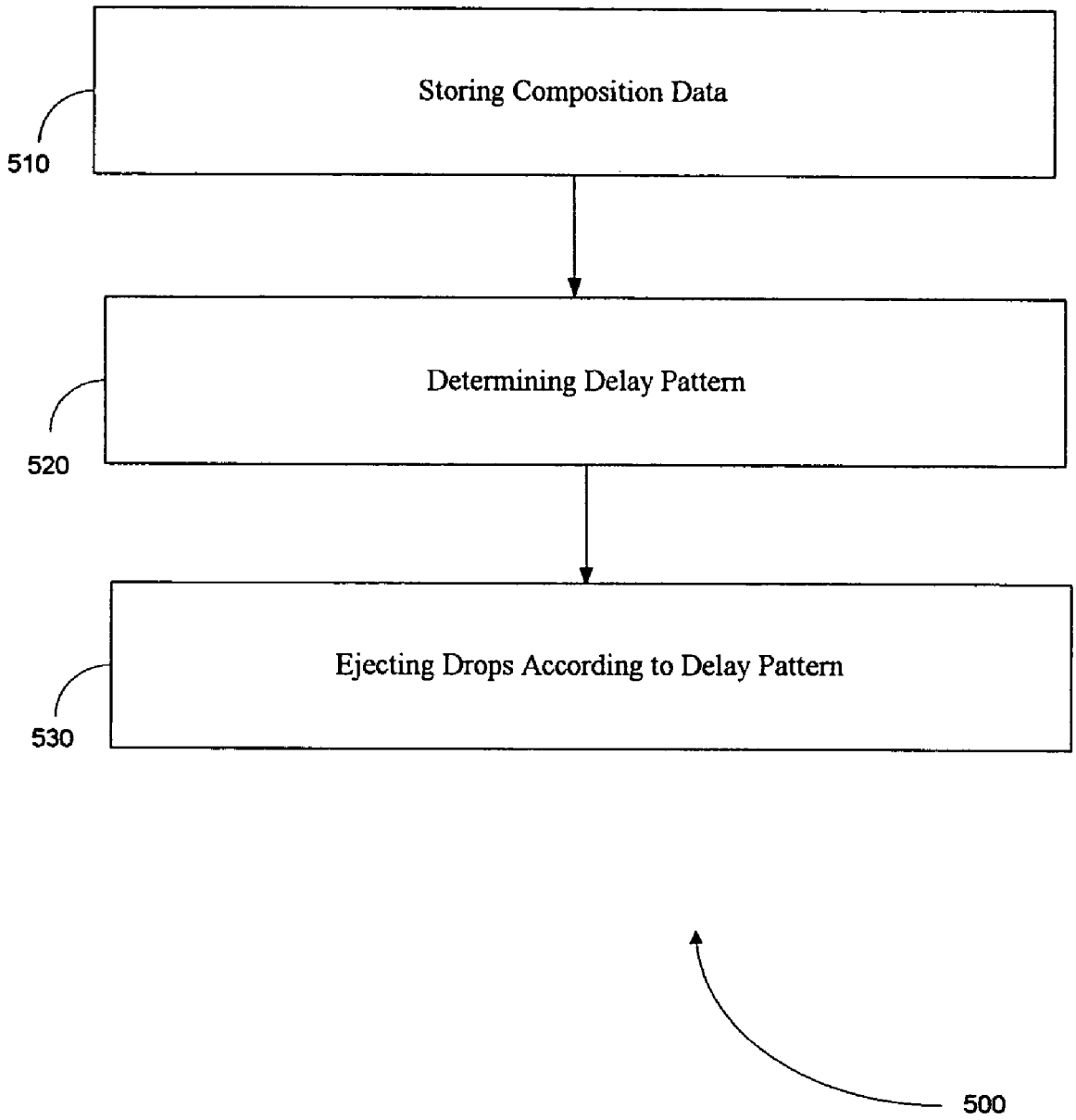
FIG. 5 is a flow chart showing an embodiment of the present invention.

FIG. 5 is a simplified flow chart showing the method 500 according to an embodiment of the present invention. First, composition data is obtained and stored 510. This composition data allows a delay pattern 520 to be determined. Once that pattern is determined, the ink drops are ejected 530 according to the delay pattern.

Figure 6:
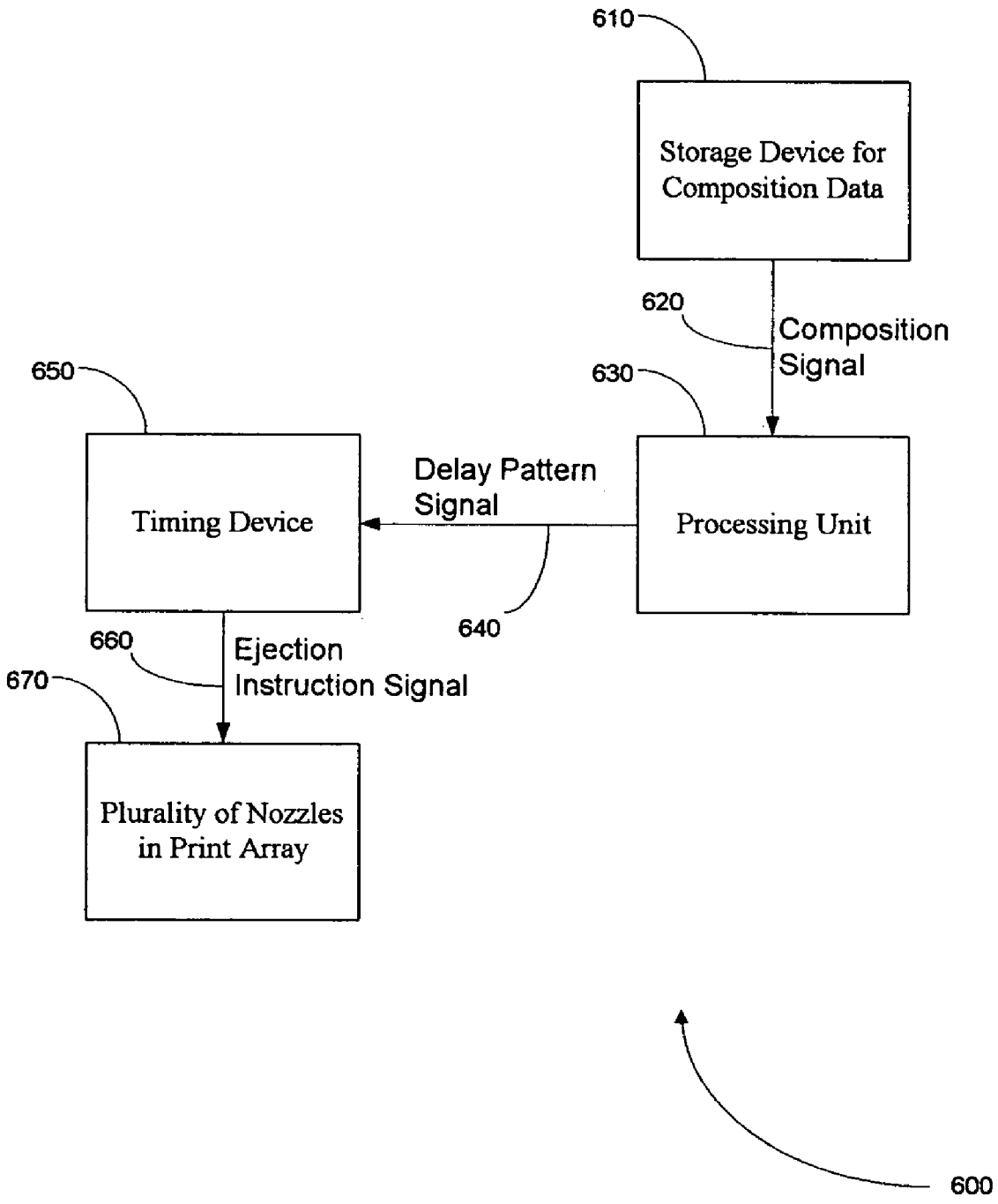
FIG. 6 is a block diagram of a system according to the present invention.

Likewise, FIG. 6 is s simplified block diagram showing the system 600 according to an embodiment of the present invention. Information indicative of the mail piece's shape is obtained and stored in the storage device 610, and this information is signaled 620 to a processing unit 630 which determines or selects a delay pattern as a function of the composition data. The processing unit then sends a delay pattern signal 640 to a timing device 650, which is able to implement those delays, and instruct 660 the nozzles 670 when to eject their ink.

It is to be understood that all of the present figures, and the accompanying narrative discussions of best mode embodiments, do not purport to be completely rigorous treatments of the method and system under consideration. A person skilled in the art will understand that the steps of the present application represent general cause-and-effect relationships that do not exclude intermediate interactions of various types, and will further understand that the various structures described in this application can be implemented by a variety of different combinations of hardware and software, and in various configurations which need not be further elaborated herein.

What is claimed is:

1. A method for ejecting ink drops from a plurality of ink jet nozzles in order to print on an envelope in a mail piece production process, each nozzle displaced in a first direction relative to a mobile surface of the envelope, and the plurality of nozzles being positioned substantially transverse to the direction of movement of said surface, wherein said surface is at least partially non-planar, comprising the steps of:

transporting the mail piece past the plurality of nozzles:

storing mail piece composition data for the mail piece;

determining a nozzle delay pattern as a function of the composition data; and for each ink jet nozzle of said plurality of ink jet nozzles, ejecting a drop of ink in accordance with the delay pattern so as to contact a point of said surface at the same time as drops from other of said plurality of ink jet nozzles contact said surface.

2. The method of claim 1, wherein the delay pattern is for delaying the ejection of ink from at least one nozzle of said plurality of ink jet nozzles, based upon an actual or estimated displacement of said nozzle in said first direction between said nozzle and the point of said surface, wherein an ink drop ejection velocity, $V_{drop}$, of each ink jet nozzle is substantially equal, and wherein the delaying of the ejection of ink from one of a pair of said nozzles is defined by $dZ/V_{drop}$ with dZ being the difference in the displacements of said pair of said nozzles.

3. The method of claim 1, wherein the nozzle delay pattern is one of a plurality of prearranged nozzle delay patterns.

4. The method of claim 1, wherein the nozzle delay pattern is at least partly determined by a curvature of the envelope calculated in response to the composition data.

5. The method of claim 1, wherein the composition data includes at least one of the following data types: shape of the mail piece, size of the envelope, envelope material, number of pages inside the envelope, and thickness of pages inside the envelope.

6. A system for ejecting ink drops from a plurality of ink jet nozzles in order to print on an envelope in a mail piece production process, each nozzle displaced in a first direction relative to a mobile surface of the envelope, and the plurality of nozzles being positioned substantially transverse to the direction of movement of said surface, wherein said surface is at least partially non-planar, comprising:

a transport for moving the mail piece past the plurality of nozzles;

a storage device for storing mail piece composition data obtained for the mail piece;

a processing unit for determining a nozzle delay pattern as a function of the composition data; and a timing device, for timing ejection of a drop of ink from each ink jet nozzle of said plurality of ink jet nozzles, in accordance with the delay pattern, so as to contact a point of said surface at the same time as drops from other of said plurality of ink jet nozzles contact said surface.

7. The system of claim 6, wherein the delay pattern is for delaying the ejection of ink from at least one nozzle of said plurality of ink jet nozzles, based upon an actual or estimated displacement of said nozzle in said first direction between said nozzle and the point of said surface, wherein an ink drop ejection velocity, $V_{drop}$, of each ink jet nozzle is substantially equal, and wherein the delaying of the ejection of ink from one of a pair of said nozzles is defined by $dZ/V_{drop}$ with dZ being the difference in the displacements of said pair of said nozzles.

8. The system of claim 6, wherein the nozzle delay pattern is one of a plurality of prearranged nozzle delay patterns.

9. The system of claim 6, wherein the nozzle delay pattern is at least partly arranged in response to the composition data.

10. The system of claim 6, wherein the composition data includes at least one of the following data types: shape of the mail piece, size of the envelope, envelope material, number of pages inside the envelope, and thickness of pages inside the envelope.

* * * * *